United States Patent [19]

Suzuki

[11] 4,392,329

[45] Jul. 12, 1983

[54] PIVOTABLE WINDOW MOVED BETWEEN LOCKED AND OPENED POSITIONS BY MEANS OF A SINGLE OPERATING HANDLE

[75] Inventor: Jyuji Suzuki, Sayama, Japan

[73] Assignee: Nippon Elumin Sash Co., Ltd., Tokyo, Japan

[21] Appl. No.: 215,551

[22] Filed: Dec. 11, 1980

[51] Int. Cl.[3] ..... E05F 9/00

[52] U.S. Cl. ..... 49/356; 49/395

[58] Field of Search ..... 49/390, 395, 356

[56] References Cited

U.S. PATENT DOCUMENTS 4,307,542 12/1981 Lense ..... 49/390

FOREIGN PATENT DOCUMENTS 1133767 11/1968 United Kingdom ..... 49/390

1289296 9/1972 United Kingdom ..... 49/356

*Primary Examiner*—Kenneth Downey

*Attorney, Agent, or Firm*—Pennie & Edmonds

[57] ABSTRACT

A pivotable window which is moved between locked and opened position by means of a single operating handle. The window comprises a window frame, a window screen, an endless belt mounted within the window frame, a plurality of locking means, and an operating mechanism. The operating mechanism is connected to both the endless belt and the locking means. Moving the operating mechanism moves the endless belt; and this, in turn, moves the locking means between a locking position, for securely holding the window screen closed, and an unlocking position, disengaged from the window screen. Further movement of the operating mechanism moves the window screen between the closed position and an open position.

15 Claims, 30 Drawing Figures

FIG.10
FIG.8
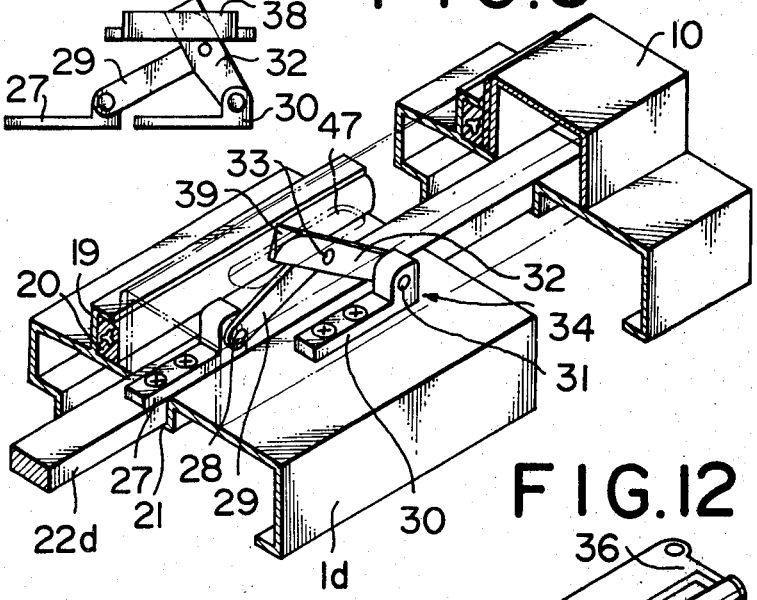
FIG.12
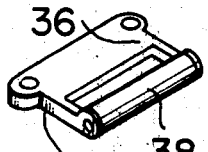
FIG.11
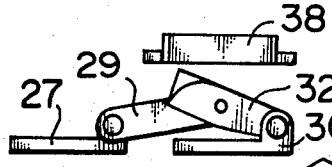
FIG.9
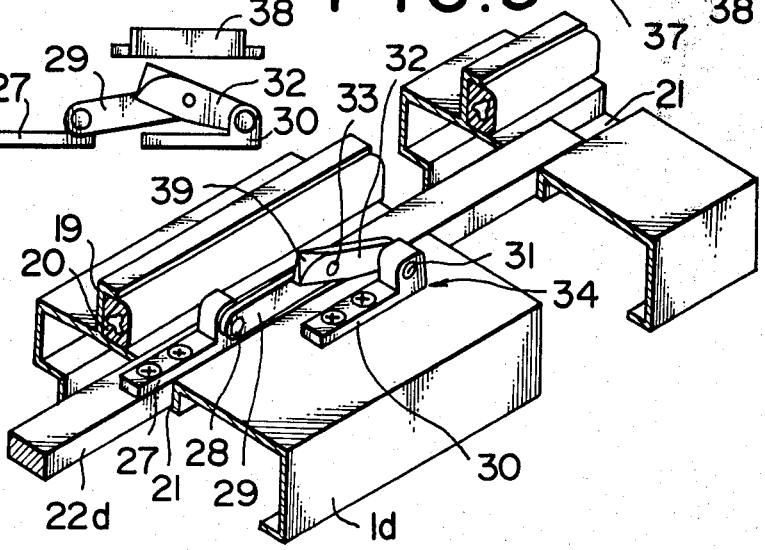

PIVOTABLE WINDOW MOVED BETWEEN LOCKED AND OPENED POSITIONS BY MEANS OF A SINGLE OPERATING HANDLE

BACKGROUND OF THE INVENTION

This invention relates to a pivotable window that may be moved between locked and open positions by means of a single operating handle.

Heretofore, a pivotable window is generally provided with a number of locking means to hold the window securely closed. To open such a window, it is necessary to unlock all the locking means one by one and to fix a window screen in an open position. Such prior art window screens are often spring biased toward a closed position, and to hold the window screen open, it is necessary to employ specific means to secure the window screen in the open position. To lock the window closed, it is necessary, first, to return the window screen to the original closed position and then to lock the locking means of the window.

It is known to lock or unlock the locking means all at once by transforming the rotational motion of an operating handle into the reciprocating motion of a sliding member, as shown for example in Japanese Patent Publication No. 34274/80 in which the sliding member is reciprocated by utilizing a link motion, and Japanese Unexamined Patent Publication No. 62100/79 in which the sliding member is reciprocated by means of a chain and sprocket wheels. However, in said two known arrangements, frictional forces make it difficult to transmit the rotational motion of the operating handle into reciprocating motion of the sliding member.

BRIEF SUMMARY OF THE INVENTION

It is an object of the present invention to provide a pivotable window that may be moved between locked and open positions by means of a single, simple, smooth operation.

A further object of the invention is to provide an improved pivotable window which can be readily assembled.

Other features and advantages of the invention will be apparent from the following description taken in connection with the accompanying drawings wherein one embodiment is illustrated by way of example.

BRIEF DESCRIPTION OF THE DRAWINGS

FIGS. 8 and 9 are perspective views, partly broken away, of the lower locking means of the window in locking and unlocking positions, respectively.

FIGS. 10 and 11 are enlarged views of the locking means shown in FIGS. 8 and 9 respectively.

FIG. 12 is a perspective view of a roller bracket used in the locking means shown in FIGS. 10 and 11.

In FIGS. 1, 3, 4 and 5, reference numeral 1 designates a window frame and numeral 2 a window screen in which an inner glass 3 and an outer glass 4 are glazed. When the window screen is opened, a lower half portion is swung in the outdoor direction H, and an upper half portion is swung in the room side direction H' by means of a pivot means as shown in FIG. 3. The window screen 2 comprises of an upper screen frame 6, left and right side screen frames 7, 8 and a lower screen frame 9. On the lower half portion of the window frame 1 and the upper half portion of the left and right side screen frames 7, 8 of the screen 2, there are secured abutment members 10, 11 and 12. When the window screen 2 is closed, resilient, sealing materials 13 of the abutment member 10 of the frame 1 tightly abut against resilient, sealing materials 15 of projection walls 14 of the screen frames 7, 8 and 9, and resilient, sealing materials 16, 17 of the abutment member 11, 12 of the left and right side screen frames members 7, 8 tightly abut against resilient, sealing material 20 of a vertical wall 19 of the window frame 1, thereby maintaining an airtight seal between window frame 1 and window screen 2 when the window screen is closed. The window frame 1 includes an upper frame member 1*a*, left and right vertical frames members 1*b*, 1*c* and a lower frame member 1*d* which are provided with grooves 21 at the surface opposite to the screen frames 6, 7, 8 and 9. In said grooves 21, there are slidably disposed sliding members 22*a*, 22*b*, 22*c* and 22*d* which have a shape of cross section adapted to said groove.

As shown in FIG. 2, a roller box 23 is arranged in said groove 21 extending over the horizontal and vertical frames at the four corners of the window frame, and a group of rollers 25 are slidably arranged along a guide portion 24 over its circular arc. At both ends of a group of rollers 25, the rollers closely contact with a connecting member 26 disposed at the end of each sliding member, whereby an endless sliding belt 49 is constructed as a whole. Numeral 100 designates a stopper so formed that the connecting member 26 does not slip out of the roller box 23. Consequently, as shown in FIGS. 6 and 7 a connection between each pair of the sliding members 22*a* and 22*b*, 22*b* and 22*d*, 22*d* and 22*c*, 22*c* and 22*a* is obtained by a group of rollers 25, and then each sliding member 22*a*, 22*b*, 22*c* and 22*d* can be reciprocally slid within groove 21.

FIGS. 8 and 9 are perspective views, partly broken away, of the main portion of the locking means 34, located at the lower portion of the window frame shown in FIG. 1. In these drawings, there is shown the sliding member 22*d* which slides in the groove 21 disposed at the upper surface of the lower window frame member 1*d*, and a connecting member 29 which is pivotally connected at 28 to the sliding member 22*d* via a fixed member 27. The connecting member 29 is linked by a pin 33 to a cam member 32 which is pivoted at 31 via a fixed member 30 at the window frame side, whereby the cam member 32 is projected or retracted due to the reciprocating motion of the sliding member 22*d*. Along the width of the window a plurality of locking means 34 are provided as shown in FIG. 1, and in this embodiment according to the invention, two locking means are provided. Screen frame 9 is provided at a position opposite to the cam member 32 with a roller bracket 36 having a roller member 38 which engages with the cam member 32 when it projects. In this embodiment, the screen frame 9 in FIG. 5 is formed with a recess 35, and the roller bracket 36 is secured within said recess 35 so that the cam member 32 can be engaged with the roller member 38 which is rotatably supported between two arms 37 projecting from the roller bracket 36 as shown in FIG. 12. It is obvious that said recess is not always necessarily needed for securing the roller bracket 36. It is noted that since the top end of the cam member 32 is formed with an inclined portion 39 as shown in FIGS. 8 and 9, the cam member 32 may readily be engaged with the roller member 38 as the cam makes contact with the roller to draw window screen 2 tightly against window frame 1 and to urge sealing materials 13, 15 against each other. If there are two locking means 34 as in the present embodiment, each fixed member 27 is secured to the same sliding member 22*d*. In this embodiment, the locking means 34 is accomodated in the abutment member 10 and the cam member projects or retracts through an opening 47 disposed at the upper surface of the abutment member 10. In this way, the screen 2 is locked airtight to the window frame 1.

Figure 6:
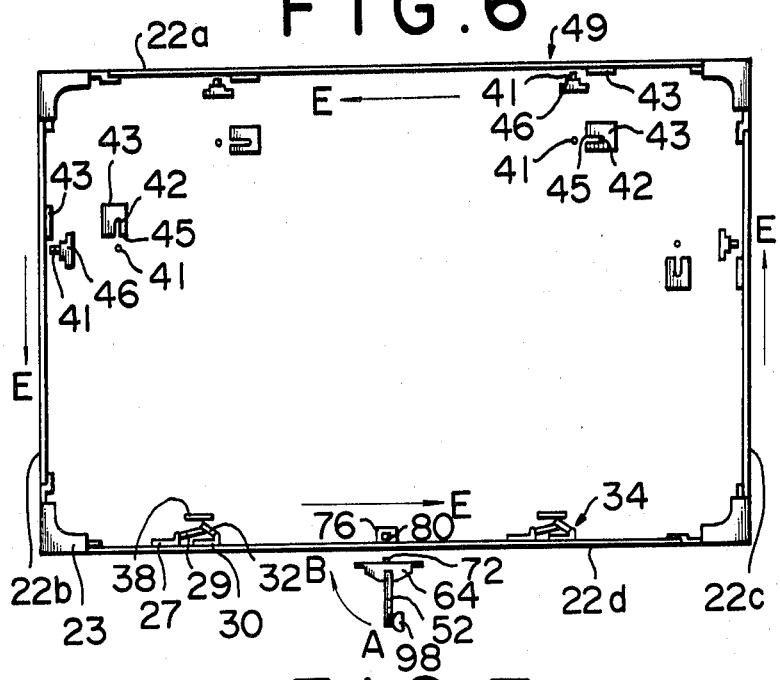
FIGS. 6 and 7 are operational diagramatic views showing the locking means of the window in unlocking and locking positions, respectively.

Furthermore, upper locking means 40 is provided in the upper screen frame 6 of the screen and in the upper half portion of the vertical frame members 7, 8. Each upper locking means 40 includes a pin 41 extending towards the window frame 1, and each sliding member 22*a*, 22*b* and 22*c* is provided with a cam plate member 43 having a guide slot 42 opposite to said pin 41. The guide slot 42 of each cam plate member 43 is directed toward one direction with respect to the moving direction of a series of endless belt 49, for example as shown in FIG. 6. A mouth 45 of the guide slot 42 is directed to the same direction as the counter-clockwise direction E of the endless belt 49, i.e. the mouth 45 is directed downwards in the left sliding member 22*b*, towards the left in the upper sliding member 22*a*, and upwards in the right sliding member 22*c*, whereby each guide slot 42 of the cam plate can simultaneously be engaged with the pin 41 due to the counter-clockwise direction E of the endless belt 49 as shown in FIG. 6.

Figure 1:
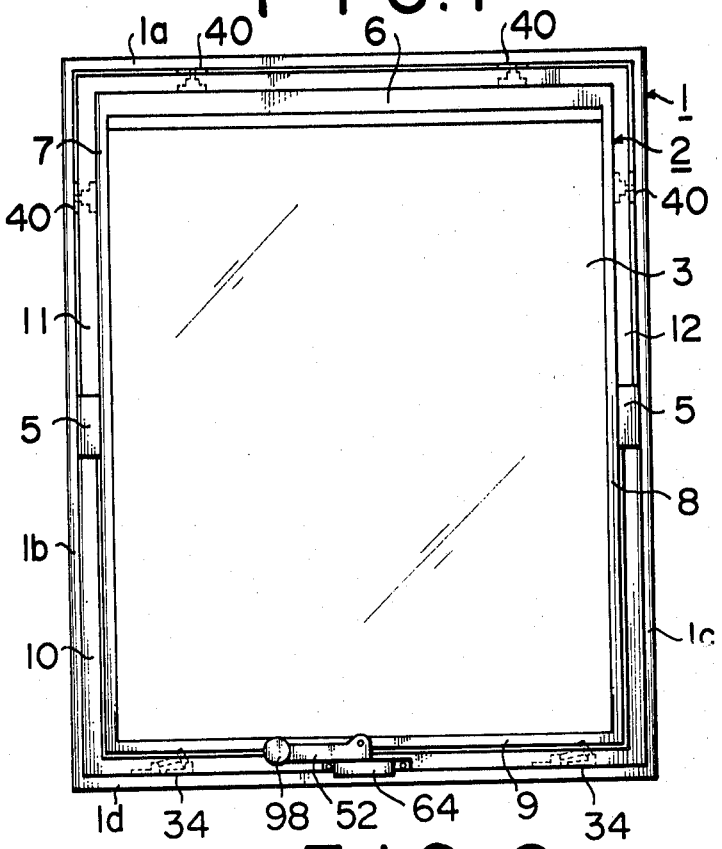
FIG. 1 is an elevational view, seen from the inside of a room, of a pivotable window according to the present invention.
Figure 2:
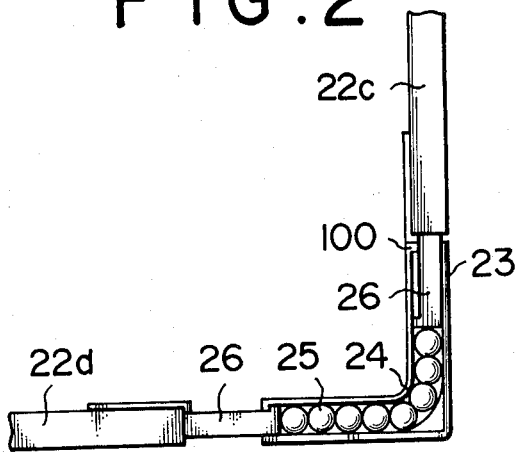
FIG. 2 is an elevational view, partly broken away, of the corner of a window frame of the window shown in FIG. 1.
Figure 3:
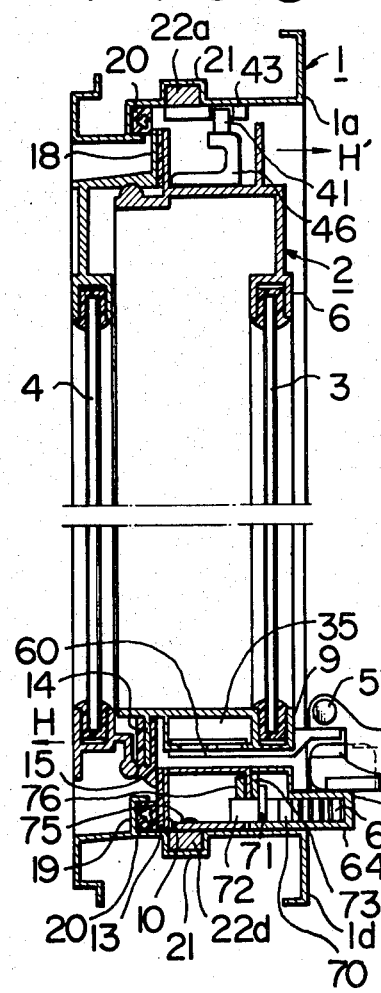
FIG. 3 is a vetical sectional view of the window shown in FIG. 1.
Figure 4:
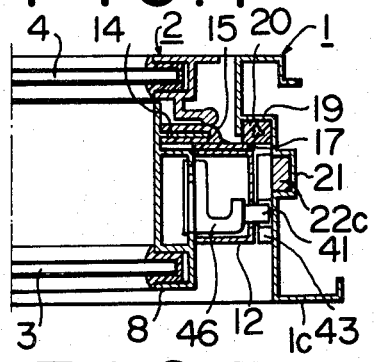
FIG. 4 is a horizontal cross sectional view of the window.
Figure 5:
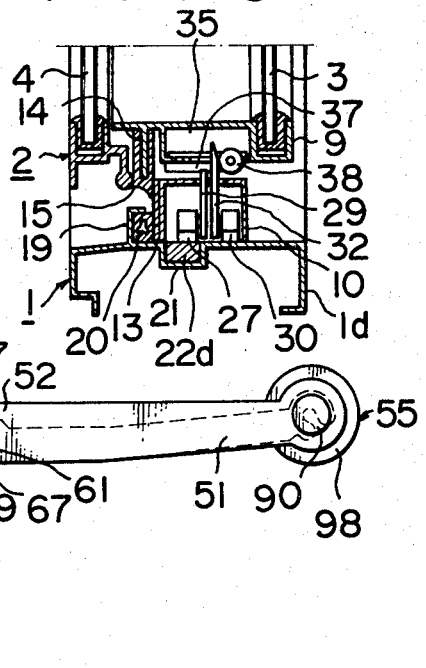
FIG. 5 is a vertical sectional view of the lower portion of the window, with the window shown in a closed and locked position.
Figure 19:
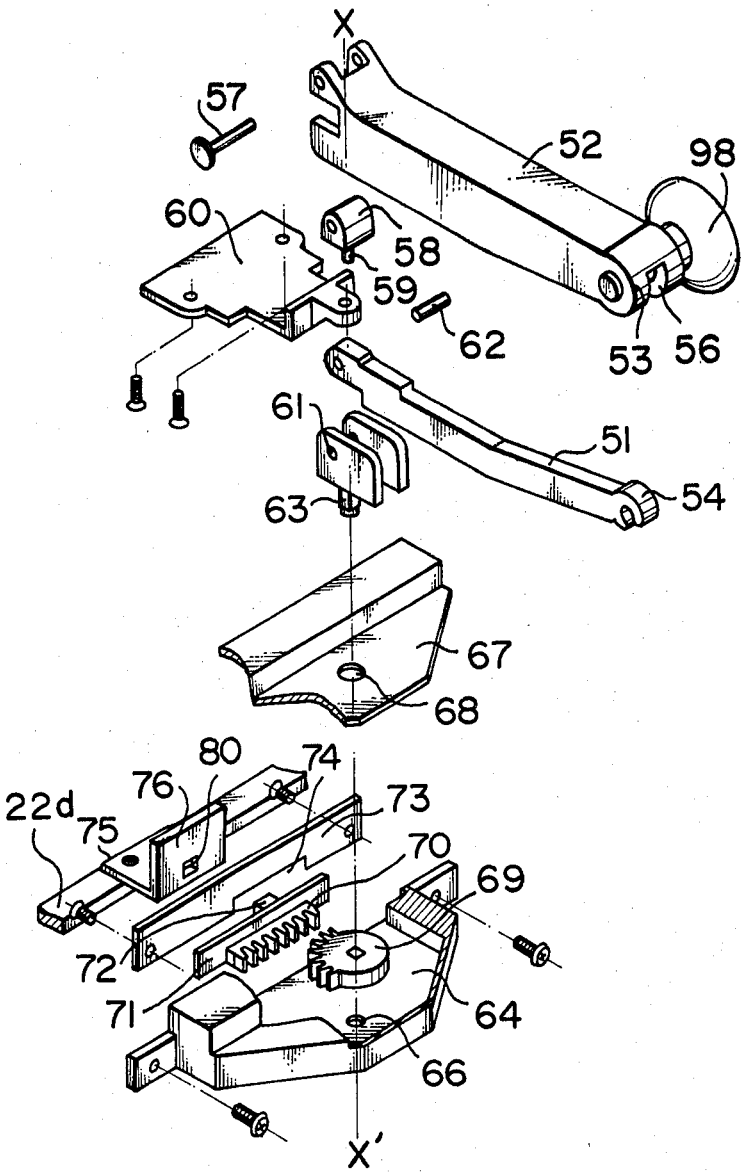
FIG. 19 is an exploded perspective view of the window opening mechanism of the window shown in FIG. 1.

FIG. 19 is a exploded perspective view of a mechanism which reciprocates belt 49 and moves the window to the open position. As shown in FIGS. 3 and 19, the mechanism is so constructed that a supporting arm 51 and an operating handle 52 are connected with each other at their ends 53, 54 and then forms a connecting portion 55 as hereinafter described. The supporting arm 51 extends in one direction and received in a lower recess 56 of the operating handle 52. The other end of the operating handle 52 is joined to a connecting member 58 which is rotatably supported by a pin 57, and said connecting member 58 is provided with a fitting plate 60 which is rotatably supported by a vertical pin 59 downwardly projecting therefrom. In this manner, both the connecting member 58 and the fitting plate 60 are connected in the form of a universal joint.

As shown in FIG. 3, said fitting plate 60 is secured to the lower middle part of the window screen 9. That is to say, the operating handle 52 is supported by the pin 59 of the connecting member 58 at the top end of the fitting plate 60, whereby the handle having in its recess the supporting arm 51 is rotatably supported in the horizontal and vertical directions. The other end of the supporting arm 51 is supported by a pin 62 and connecting member 61. Connecting member 61 is provided with a vertical pin 63 downwardly projecting therefrom, which pin extends through a hole 66 of a bottom plate of a gear box 64 secured to the window frame member 1*d* and through a hole 68 of a cover 67 of said gear box 64, so that both the supporting arm 51 and the connecting member 61 are joined in the form of a universal joint.

Each of vertical pins 59, 63 of said two connecting members 58, 61 are aligned with the line X—X′ as shown in FIG. 19.

At the middle part of the vertical pin 63 of the connecting member 61 there is mounted a pinion 69 which may be rotated by said pin 63. Said pinion 69 is meshed with a rack 70. Said rack is provided with a flange portion 71 from which a projection 72 is protruded.

Secured to the gear box 64 is a guide plate 73 which covers the opening of the gear box 64 and slidably guides the said flange portion 71. The guide plate 73 is provided with an opening 74 so that the projection 72 may freely be reciprocated therein.

On the lower sliding member 22*d* of the endless belt 49 there is secured a connecting member 75 having L-shaped cross section, a vertical wall 76 of which member is provided with a hole 80 into which said projection 72 is inserted. When the gear box is mounted to the abutment member 10 at the lower portion of the window as shown in FIG. 3, said projection 72 extends into said hole 80 and transmits the reciprocating movement of the rack 70 to said sliding member 22*d*. The rack 70 and the lower sliding member 22*d* are so constructed as to slide as one body by the rotational movement of the pinion 69.

Figure 7:
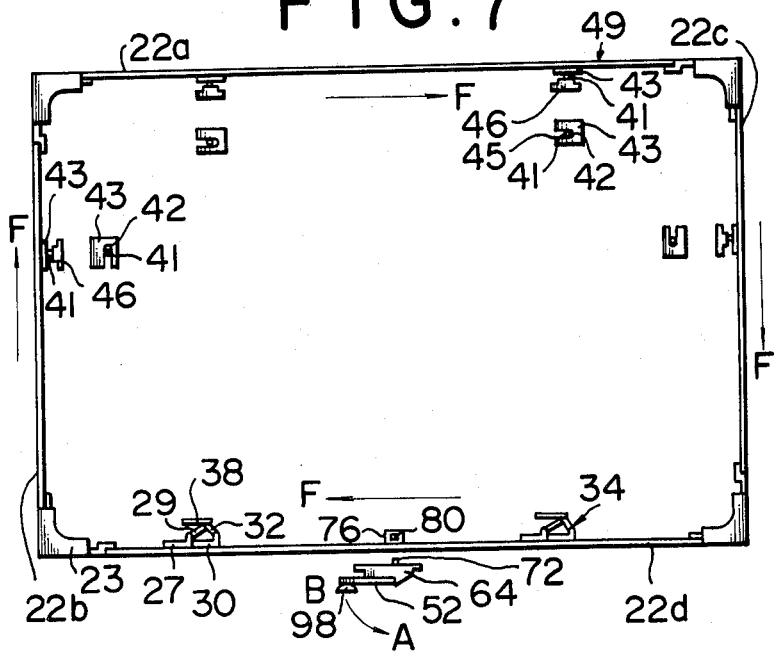
Figure 13:
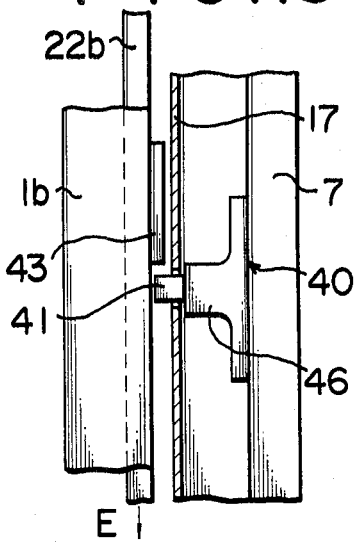
FIGS. 13 and 14 are elevational views, partly cut away, of the upper locking means of the window in unlocking and locking positions, respectively.

When the endless belt 49 moves from the position of FIG. 6 to that of FIG. 7, i.e. when the window screen is in the locked position by the action of all the roller members and the cam members, the operating handle 52 is disposed parallel to the surface of the window. The operating handle 52 is so constructed that when it is rotated through 90° from the above mentioned parallel position to the position being perpendicular to the surface of the window as shown in FIGS. 20 and 21, the belt 49 can be moved in the direction of arrow F with the rack 71 being moved by the 90° rotation of the pinion 69.

Figure 14:
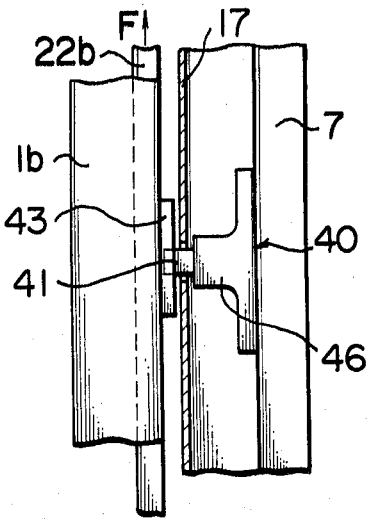
Figure 15:
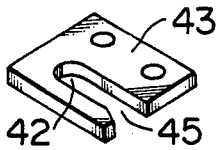
FIGS. 15 and 16 are perspective views showing a cam plate and a pin of the upper locking means shown in FIGS. 13 and 14.
Figure 16:
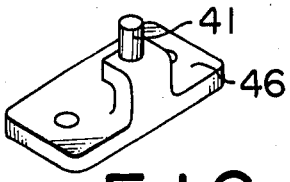
Figure 17:
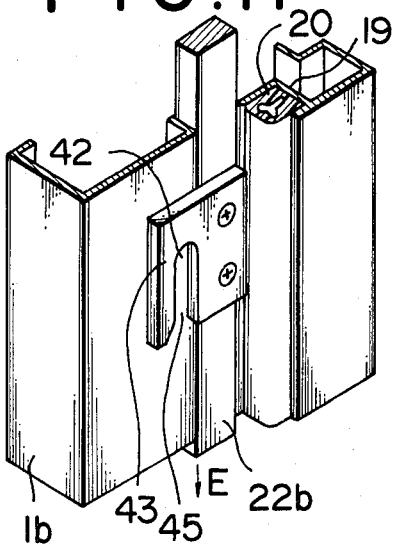
FIGS. 17 and 18 are perspective views, partly broken away, of the cam plate and sliding member shown in FIGS. 13 and 14 respectively.
Figure 18:
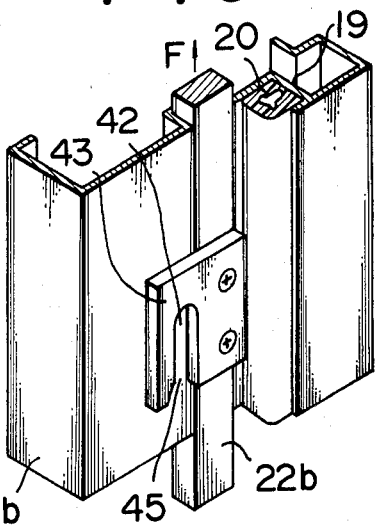
Figure 20:
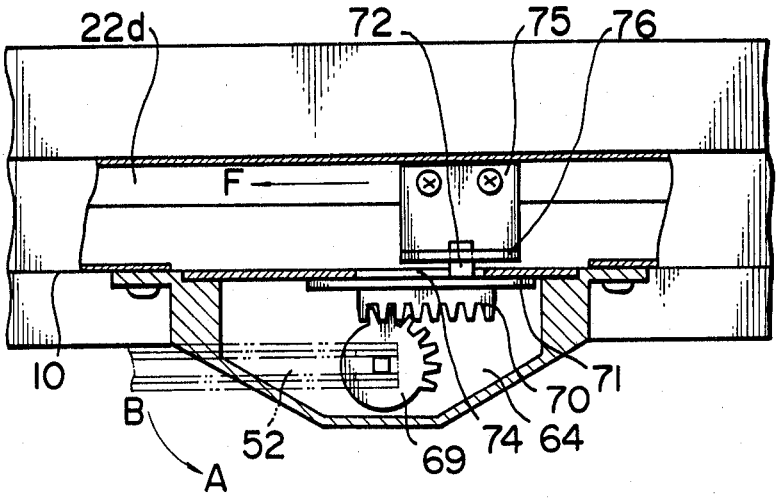
FIGS. 20 and 21 are plan views, partly broken away, of the gear box of the window opening mechanism.
Figure 21:
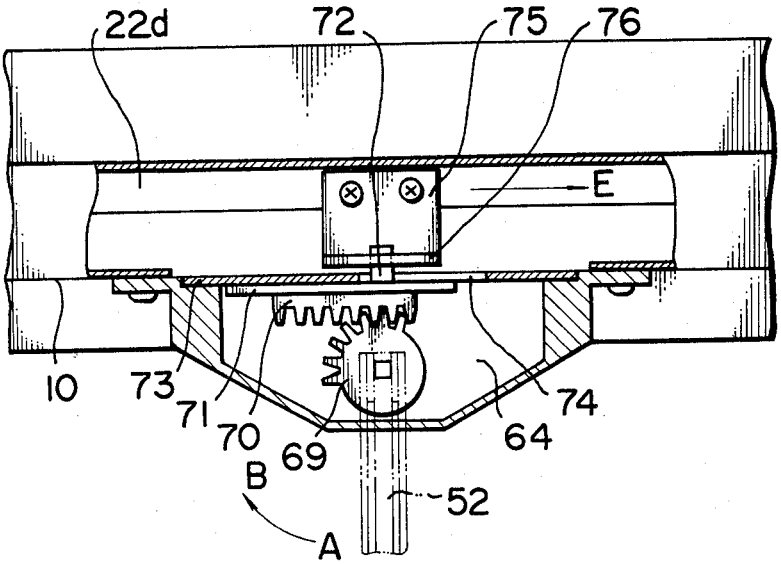
Figure 22:
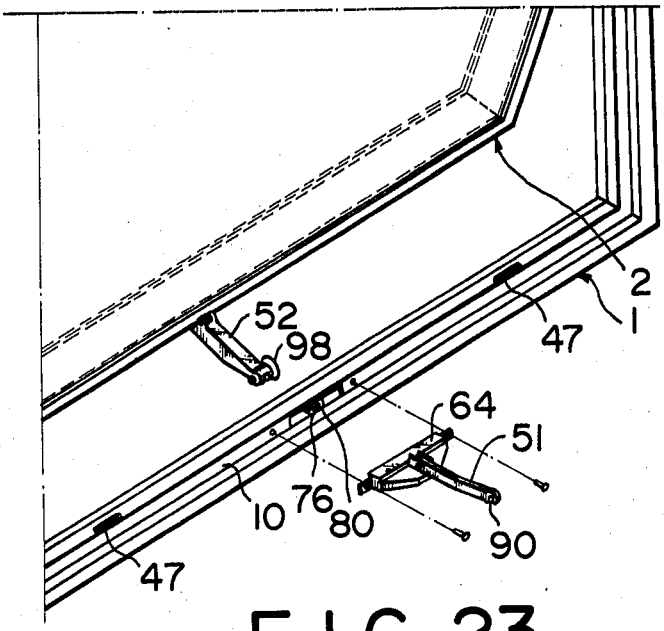
FIG. 22 is a fragmentary perspective view showing the fitting of the window opening mechanism.

As mentioned above, when the operating handle 52 is rotated from the position being parallel to the window surface to the position being perpendicular to the window surface by 90° rotation of the handle as shown in FIGS. 20 and 21, and when the pinion 69 is rotated through 90°, the lower sliding member 22*d* is moved by the rack 71 meshing with the pinion, the cam member 32 of the locking means 34 is pivoted upward as shown in FIG. 8 and engages with the roller member 38 opposite to the cam member as shown in FIG. 10, and the cam plate member 43 of the locking means 40 is engaged with the pin 41 as shown in FIG. 14.

The shape of the teeth, the pitch circle and the number of teeth, of the pinion 69 and the rack 71 are so designed that the strokes of the cam member 32 and the cam plate member 43 correspond to those being necessary to release the roller member 38 and the pin 41 respectively, whereby the stroke by which the lower sliding member 22*d* can be moved is determined.

Figure 24:
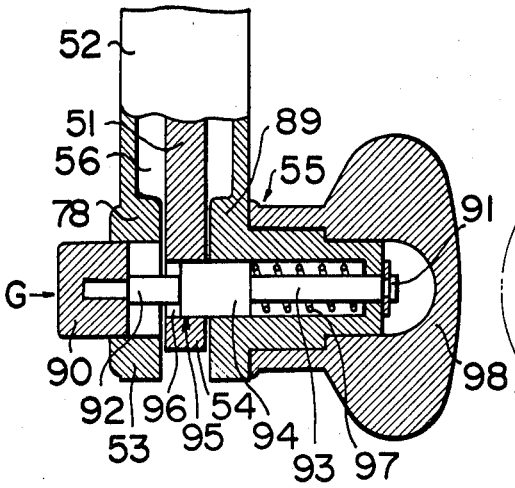
FIGS. 24, 25, 26, and 27 are cross sectional views, partly broken away, of the grip portion of the window opening mechanism.
Figure 25:
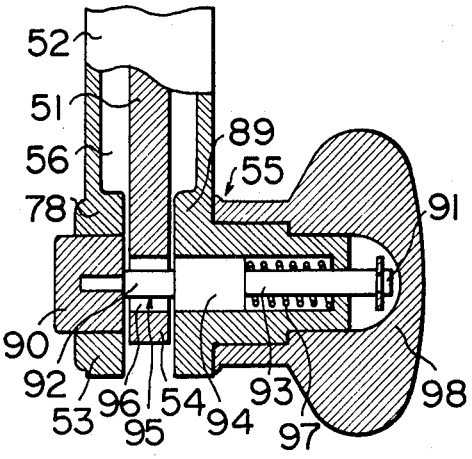

FIGS. 24 and 25 are cross sectional views showing the connecting portion 55 between the operating handle 52 and the supporting arm 51. A shaft 95 is provided with smaller diameter portions 92, 93 and a larger diameter portion 94. Push button 90 is secured to one end of shaft 95 and the other end of the shaft is provided with a collar 91 and a clip to secure the shaft to the handle. Said shaft is slidably mounted in a recess of the handle via a spring 97. In the recess 56 of the handle a free end 54 of the supporting arm 51 is inserted, and the handle and the arm are rotatably connected by passing the shaft 95 through a hole 96 of the arm. Said shaft 95 is so constructed that spring 97 urges the larger diameter portion 94 into the hole 96 and the smaller diameter portion 92 may be pushed within the hole 96 by pushing the button 90. Numeral 98 designates an operating grip which is secured to the projecting portion of the operating handle 52.

Figure 26:
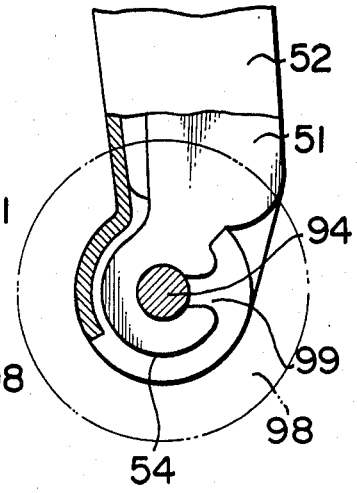
Figure 27:
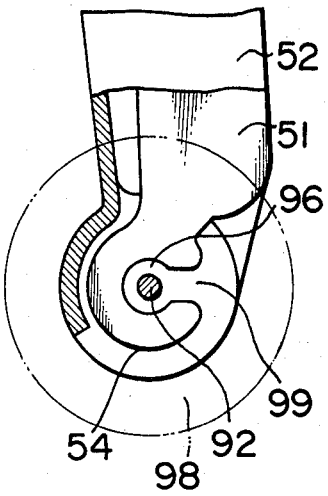

The hole 96 of the arm 51 is provided with a notch 99 through which only the smaller diameter portion 92 can be passed as shown in FIGS. 26 and 27.

The operation of the above described mechanism and further constructional features and advantages will now be explained.

When the window is in unlocking condition as shown in FIGS. 6 and 21, if the operating handle 52 is rotated through 90° from position A which is perpendicular to the window surface to the position B, the handle 52 together with the supporting arm is smoothly rotated about the vertical pin 63 via the connecting member 61. Thus, the pinion 69 is rotated to the position shown in FIG. 20 by the vertical axis 63 of the connecting member 61 and the rack 70 is reciprocated. Therefore, the belt 49 is moved counter clockwise E as shown in FIG. 6 by the movement of the rack 70, leading to the position shown in FIG. 7.

That is to say, in the lower window frame member 1*d*, the sliding member 22*d* causes the cam member 32 to pivot upward via the connecting rod 29 as shown in FIG. 9. Then the cam 32 at its inclined surface 39 is forced to engage the roller member 38 opposite to the cam, against the resilient force of the airtight materials 13, 15, and engaged with the side of the roller 38, thereby bringing the window screen into tight contact with the abutment member 10 of the window frame 1. In this way, the lower half portion of the window screen is locked.

Similarly, in the upper half portion of the window screen, the sliding members 22*a*, 22*b* and 22*c* are slid in the groove of the window frame in the direction of arrow E of FIG. 6, each cam plate member 43 secured thereon is as shown in FIG. 14 penetrated at the notch portion 45 by the pin 41, and then each pin may simultaneously be engaged with the guide slot 42 against the resilient force of the airtight material 20 of the window frame 1 and of the airtight materials 16, 17 of the window screen 2, and therefore, the upper half portion of the screen can be locked.

In this embodiment, the window is equipped with six locking means but it will be understood that it may be provided with more than six locking means.

These locking operations are simultaneously and smoothly accomplished in a short time by reciprocating the belt 49 in the groove of the window frame due to rotational movement of one operating handle.

To unlock and open the window, that is to move the window to the position shown in FIGS. 7 and 20, the operating handle is rotated from the position B to the position A. The pinion 69 is rotated, the rack is moved, and then the endless belt 49 is moved toward the arrow F, thus the cam member 32 is retracted and then released from the engagement with roller member 38, and at the same time, the cam plate member 43 is released from engagement with the pin 41. In this way, the window is unlocked all at once.

Figure 28:
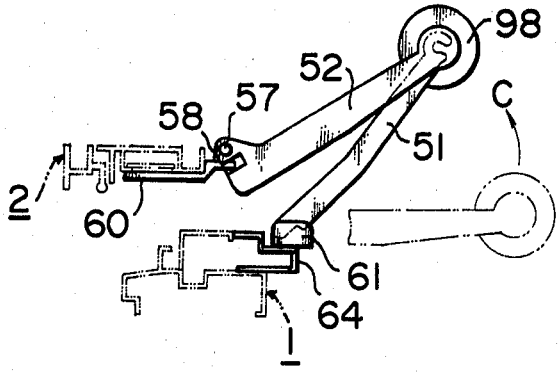
FIGS. 28, 29, and 30 are diagramatic, left side views of the window handle in intermediate, open, and partially disassembled positions, respectively.

When the window is unlocked and the operating handle is perpendicular to the window surface, to open the window screen, the handle 52 is pushed up toward the arrow C as shown in FIG. 28. The handle 52 and the supporting arm 51 are extended until they are approximately in a straight line due to the extraction of the supporting arm received in the recess 56 of the handle, and stopped at the position shown in FIG. 29. The handle and the arm, it should be remembered, are connected to each other at first ends, with a second end of the handle pivotally supported by the fitting plate 60 which is secured to the screen frame 2, and with a second end of the arm pivotally supported by the gear box 64 which is secured to the window frame via a universal joint.

Figure 23:
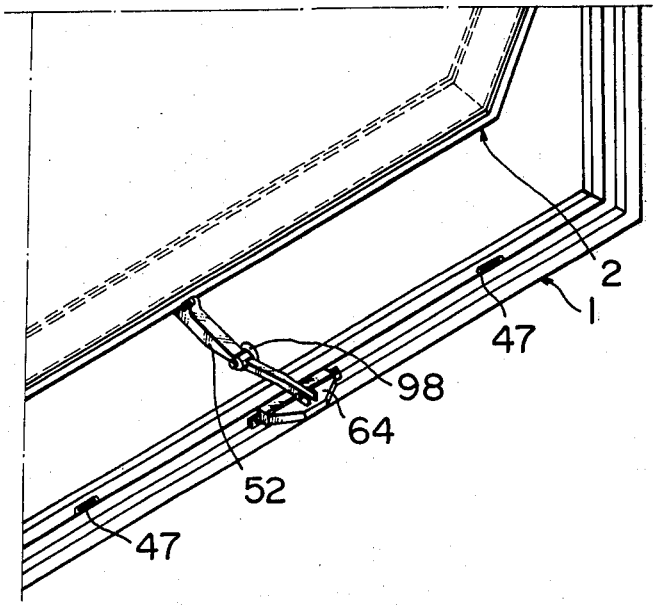
FIG. 23 is a fragmentary perspective view showing the window screen in an open position.
Figure 29:
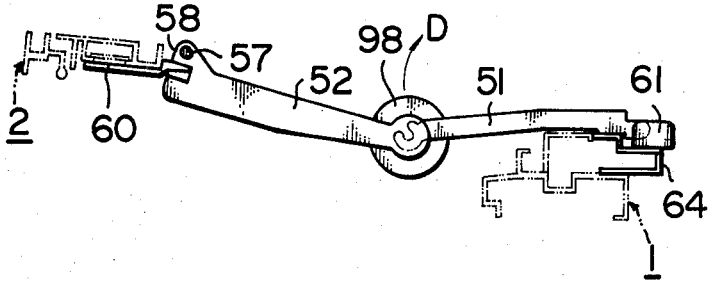
Figure 30:
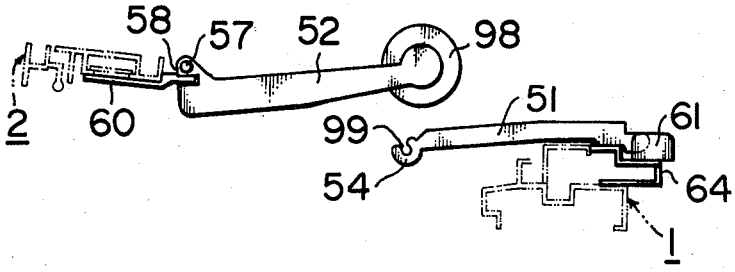

The screen 2 fitted with the fitting plate 60 is gradually opened according to the swinging movement of the arm 51, stopped at the position shown in FIG. 29 and then maintained to the window opening position as shown in FIG. 23.

When the window screen is to be closed, it will suffice to pull upward the grip 98 of the handle toward the arrow D as shown in FIG. 29 and then the screen is gradually closed by reversing the procedure mentioned above.

The handle 52 and the arm 51 are rotatably connected by the shaft 95 as shown in FIG. 24 so that the larger diameter portion 94 of the shaft normally extends into the hole 96 of the arm, and the smaller diameter portion 92 of the shaft is moved within the hole 96 by pushing the button 90 in the direction of arrow G as shown in FIGS. 25 and 27. This easy removability of shaft 95 from the slot 99 of the arm 51, and the handle 52 from the arm 51, is especially useful when the screen is reversed or removed.

The handle 52 and the arm 51 can readily be connected by bringing the smaller diameter portion 92 of the shaft into the recess 56 of the handle 52 by means of push button 90, and then by engaging the hole 96 at its notch 99 with said portion 92.

In this manner, in the window according to the invention, a number of locking means can be locked or unlocked all at once by horizontally swinging one operating handle.

Further, the window according to the invention can be opened by extending the handle and surely maintained in the opening position.

While the described embodiment represents the preferred form of the present invention, it is to be understood that modifications and variations can be made by those skilled in the art without departing from the scope of the invention. For example, it may of course be applied to the window having vertical pivot means or other entrance window.

What I claim is:

1. A window comprising:
- a window frame including upper, lower, left, and right frame members, and defining a plurality of corners and an inner, peripheral groove extending around the interior of the frame;
- a window screen;
- means connecting the window screen to the window frame for pivotal movement therewithin between open and closed positions;
- a movable endless belt extending around the interior of the window frame and including
- upper, lower, left, and right sliding members supported by the window frame for reciprocating movement within the inner peripheral groove of the frame,
- a plurality of rollers connecting ends of adjacent sliding members to translate reciprocating movement thereof around the corners of the frame, and
- means supported by the frame for guiding movement of the rollers around the corners of the frame;
- locking means including
- first means secured to the window screen,
- second means supported by the window frame for movement between a locking position, to engage the first means and securely hold the window screen in the closed position, and an unlocking position, disengaged from the first means, and
- link means connecting the second means with the endless belt to move the second means between the locking and unlocking positions; and
- an operating mechanism connected to the endless belt to move the endless belt and the second means between the said locking and unlocking positions, and also connected to the window screen to move the window screen between its open and closed positions.

2. A window according to claim 1 wherein the operating mechanism includes:
- a rack connected to the endless belt to reciprocate the belt;
- a pinion supported by the window frame and meshing with the rack to reciprocate the rack,
- a support arm supported by the window frame for both horizontal and vertical pivotal movement, and connected to the pinion to pivot the pinion, and
- a handle connected to the window screen and to the support arm for horizontal and vertical pivotal movement to pivot the support arm and to move the window screen between the open and closed positions.

3. A window according to claim 1 wherein each sliding member includes a connecting member closely contacting the rollers.

4. A window according to claim 1 wherein:
- the first means includes
- a plurality of pins secured to the window screen,
- a bracket secured to the window screen, and
- a roller rotatably supported by the bracket; and
- the second means includes a plurality of plates defining openings for receiving the pins as the locking means moves into the locking position, and
- a cam member to engage the roller as the locking means moves into the locking position.

5. A window according to claim 1 further including a shaft releasably connecting the handle to the support arm.

6. A window according to claim 2 wherein the shaft includes a smaller diameter portion and a larger diameter portion.

7. A window according to claim 6 wherein:
- the shaft includes a connecting position to connect the handle and support arms together, and a releasing position to disengage the support arm from the handle; and
- the operating mechanism further includes a button to move the shaft from its connecting position to its releasing position.

8. A window according to claim 1 wherein the connecting means connects the window screens to the window frame for pivotal movement about the horizontal axis.

9. A window according to claim 1 wherein the connecting means connects the window screen to the window frame for pivotal movement about the vertical axis.

10. A window comprising:
- a window frame including upper, lower, left, and right frame members, and defining an inner peripheral groove extending around the interior of the frame;
- a window screen;
- means connecting the window screen to the window frame for pivotal movement therewithin between open and closed positions;
- an endless belt extending around the interior of the frame and including upper, lower, left, and right sliding members supported by the window frame for reciprocating movement within the inner periphera groove;
- locking means having a locking position to lock the window screen in the closed position, and an unlocking position disengaged from the window screen, and including
- a plurality of pins secured to the window screen,
- a bracket secured to the window screen,
- a roller rotatably supported by the bracket,
- a plurality of plates secured to the endless belt and defining openings for receiving the pins as the locking means moves into the locking position,
- a cam member supported by the window frame for movement between a first position, to engage the roller and securely hold the window screen in the closed position, and a second position, disengaged from the roller, and
- link means connecting the cam member with the endless belt to move the cam member between the first and second positions; and
- an operating mechanism including a rack connected to the endless belt to reciprocate the belt, a pinion supported by the window frame and meshing with the rack to reciprocate the rack, a support arm connected to the pinion to pivot the pinion, and supported by the window frame for horizontal and vertical pivotal movement, and an operating handle connected to the window screen and to the support arm for horizontal and vertical pivotal movement and to move the window screen between the opened and closed positions.

11. A window according to claim 10 further including a shaft releasably connecting the handle to the support arm.

12. A window according to claim 11 wherein the shaft includes a smaller diameter portion and a larger diameter portion.

13. A window according to claim 12 wherein:

the shaft includes a connecting position to connect the handle and support arms together, and a releasing position to disengage the support arm from the handle; and the operating mechanism further includes a button to move the shaft from its connecting position to its releasing position.

14. A window according to claim 10 wherein the connecting means connects the window screens to the window frame for pivotal movement about a horizontal axis.

15. A window according to claim 10 wherein the connecting means connects the window screen to the window frame for pivotal movement about a vertical axis.

* * * * *